US005975057A

United States Patent [19]

Repplinger et al.

[11] Patent Number: 5,975,057

[45] Date of Patent: Nov. 2, 1999

[54] FUEL INJECTOR CONTROL CIRCUIT AND SYSTEM WITH BOOST AND BATTERY SWITCHING, AND METHOD THEREFOR

[75] Inventors: Scott Repplinger, Lake Zurich; Richard Sawyer, Vernon Hills, both of Ill.

[73] Assignee: Motorola Inc., Schaumburg, Ill.

[21] Appl. No.: 09/054,038

[22] Filed: Apr. 2, 1998

[51] Int. Cl.[6] ..... H01H 47/32

[52] U.S. Cl. ..... 123/490; 361/154

[58] Field of Search ..... 123/478, 490; 361/152, 154

[56] References Cited

U.S. PATENT DOCUMENTS 4,479,161 10/1984 Henrich et al. ..... 123/490 X
4,729,056 3/1988 Edwards et al. ..... 361/154 X
4,764,840 8/1988 Petrie et al. ..... 123/490 X
5,701,870 12/1997 Gottshall et al. ..... 123/490

*Primary Examiner*—Tony M. Argenbright
*Attorney, Agent, or Firm*—Gary J. Cunningham

[57] ABSTRACT

A fuel injector control circuit and method include first switching circuitry (128, 134, 138, 142, 148, 152, 154) to selectively apply a first electrical signal (171) to a solenoid (114) to vary a load signal (176) between a first maximum (201) threshold and a first minimum (203) threshold. Second switching circuitry (130, 132, 136, 140, 148, 154) to selectively applies a second electrical signal (198) to the load (114) to vary the load signal (176) between a second maximum (205) threshold and a second minimum (207) threshold. The second electrical signal (198) has a magnitude substantially higher than the first electrical signal. Preferably, the second maximum threshold (205) has a magnitude less than a magnitude of the first maximum threshold (201), and greater than a magnitude of the first minimum threshold (203), and the second minimum threshold (207) has a magnitude less than the magnitude of the first minimum threshold (203).

19 Claims, 5 Drawing Sheets

FUEL INJECTOR CONTROL CIRCUIT AND SYSTEM WITH BOOST AND BATTERY SWITCHING, AND METHOD THEREFOR

FIELD OF THE INVENTION

The present invention relates to control systems, and more specifically to electrical power conversion circuits and is beneficial to the control of fuel injectors in an internal combustion engine.

BACKGROUND OF THE INVENTION

Fuel injection systems are widely used in internal combustion engines. These fuel injection systems typically employ one or more solenoid operated fuel injectors that provide fuel to a corresponding combustion chamber at the appropriate time during the combustion cycle of the internal combustion engine. By controlling the amount of fuel introduced into the combustion chamber, the overall operation of the engine can be more effectively controlled.

Electronic control systems are used for controlling the timing, the waveshape, amplitude, and the duration of the signals which actuate the fuel injectors. The electronic control system usually provides a relatively high amplitude current to the fuel injectors during an initial or pull-in period of time to achieve an initial actuation of the solenoid operated fuel injectors. Subsequently, a smaller magnitude current is provided to the solenoid operated fuel injectors to maintain actuation of the solenoid during a subsequent holding or hold period of time. As a result of this "peak and sustain" or "peak and hold" control, the energy required to operate the fuel injector solenoid is usually increased since the relatively high amplitude current is initially permitted to ensure a fast actuation response of the solenoid while the smaller magnitude current is utilized to maintain the actuation of the solenoid with less power dissipated. These electronic control systems typically have a reliable and stable source of power (i.e., an alternator/battery system of a vehicle) that applies energy to the solenoids of the fuel injectors. When energy is initially applied to the fuel injectors, current flow through the fuel injectors will build up gradually due to the inductance of the solenoids. However, the mechanics of the fuel injectors will not actuate until the current reaches a certain threshold which depends on the characteristics of the electromagnetic and mechanical properties of the actuators. The amount of time for the current to build up to actuate the fuel injectors is dependent upon the voltage applied to the fuel injector.

In most vehicles, the power supplied to the fuel injectors is provided by a battery, usually producing a nominal 12 volt DC signal. However, the voltage of the battery can vary substantially during normal operation of the vehicle. When the battery voltage is low, it will take longer for the current in the fuel injectors to build up than when the battery voltage is high. In addition, under certain conditions, the battery voltage may drop to an inadequately low level which may not build up or maintain adequate current in the solenoids of the fuel injectors.

In some prior art systems, in addition to utilizing power from a battery, a high voltage power supply, known as a "boost" power supply, has been applied to the fuel injectors at the beginning of the pull-in period of time to overcome the solenoid inductance and the inertia of the fuel injector solenoid mechanics. Typically, this boost power supply includes a large reservoir capacitor to provide high peak power. The boost power supply can build up solenoid current quickly to insure rapid turn-on of the fuel injectors in response to a control signal. The boost power supply is usually only driving the fuel injector solenoid at the beginning of the pull-in period of time.

However, in some applications, where operation is required at very low battery voltages, it may be necessary to apply the boost power supply at instants other than just during the initial current rise time. Furthermore, in some applications, a rapid succession of boost power supply sourced pull-in pulses may be required, thus significantly increasing the boost power supply's power rating, and the recovery rate of the reservoir capacitor between rise times. Typically, the boost power supply is designed oversized in order to meet these requirements. In addition, the power dissipated by the boost power supply is significant and proportional to the boost power supply's power rating, thus it is desirable to appropriately size the boost power supply by minimizing a proportion of energy delivered by the boost power supply and to maximize a proportion of energy delivered by the battery supply to the fuel injector solenoid.

What is needed is an improved approach for driving loads, solenoids in particular, that will operate under low battery voltage to supplement the drive provided by the battery.

DESCRIPTION OF THE PREFERRED EMBODIMENTS

Figure 1:
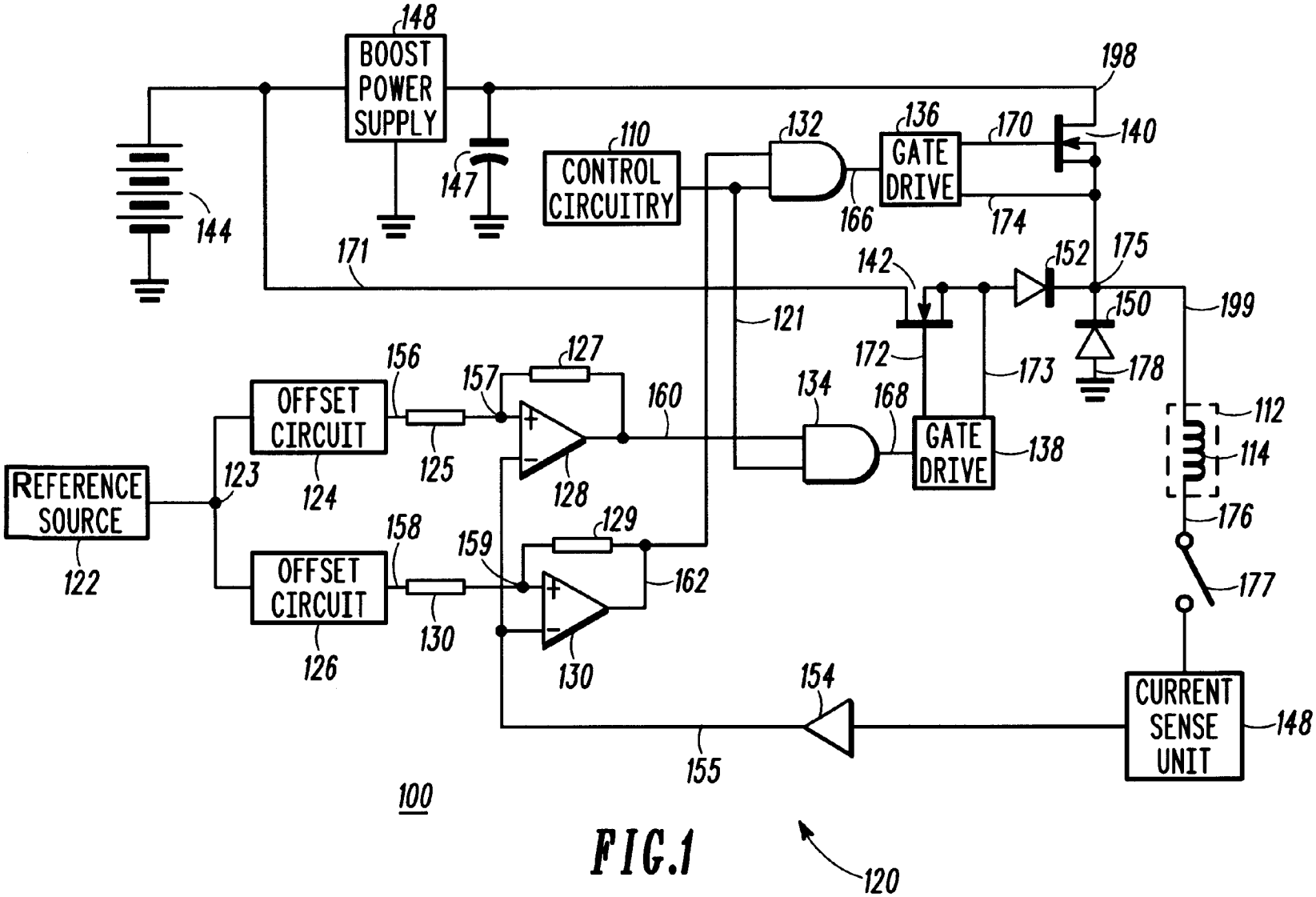
FIG. 1 is a schematic diagram of a fuel injection control system associated with a fuel injector of an internal combustion engine, providing overlapping hysteresis control of the injector solenoid current.

FIG. 1 shows a schematic diagram of a fuel injection control system 100 for use in conjunction with an internal combustion engine (i.e., a spark ignition engine, a diesel engine, etc.). The fuel injection control system 100 preferably controls the operation of a fuel injector 112. The fuel injector 112 preferably includes a corresponding electromagnetic solenoid 114 for operating the fuel injector 112. The fuel injector 112 is adapted to inject fuel for a period of time when an excitation current 176, or solenoid signal is provided to the solenoid 114. Although only one fuel injector 112 is illustrated, the fuel injection control system 100 can be adapted to control the actuation of any suitable number of fuel injectors.

The fuel injection control system 100 selectively applies a battery voltage signal $V_{battery}$ 171 and a boost voltage signal $V_{boost}$ 198 to the solenoid 114. The boost voltage signal $V_{boost}$ 198 preferably has a substantially higher voltage than the battery voltage signal $V_{battery}$ 171. The boost voltage signal $V_{boost}$ 198 is initially applied to the solenoid 114 of the fuel injector 112 to quickly increase the current 176 flowing though the solenoid 114, thereby rapidly actuating the fuel injector 112. When the fuel injector 112 is actuated, fuel is injected into a corresponding cylinder of the internal combustion engine. The boost voltage signal $V_{boost}$ 198 is also used to assist the battery voltage signal $V_{battery}$ 171 to provide additional current to the solenoid 114 during low battery voltage conditions, such as during engine cranking, where a starter motor loads down the battery/alternator system.

During the actuation of the fuel injector 112, the battery voltage signal $V_{battery}$ 171 is applied to the solenoid 114 if the current 176 flowing through the solenoid 114 reaches or is less than a minimum battery current level. The battery voltage signal $V_{battery}$ 171 is disconnected from the solenoid 114 when the current 176 flowing through the solenoid 114 reaches a maximum battery current level. In addition, the boost voltage signal $V_{boost}$ 198 can be applied when the current 176 flowing through the solenoid 114 reaches or is less than a minimum boost current level, which is typically less than the minimum battery current level. The boost voltage signal $V_{boost}$ 198 is disconnected from the solenoid when the current 176 reaches a maximum boost current level. As further described below, the current flowing through the solenoid 114 can vary between the maximum and minimum battery current thresholds, the maximum and minimum boost current thresholds, and/or the maximum battery current threshold and the minimum boost current threshold. These thresholds will be described in detail below.

As shown in FIG. 1, the fuel injection control system 100 includes control circuitry 110 and drive, or waveform control, circuitry 120. Although the fuel injection control system is shown as 100 being constructed with various types of independent and separate units or devices, the fuel injection control system 100 can be implemented by one or more integrated circuits, or a microprocessor, or a microcontroller which can be programmed to execute the operations or functions equivalent to those performed by the circuits or units shown. It will also be recognized that the system can be realized in the form of hardware components and circuit designs, software or computer programming, or a combination thereof.

The control circuitry 110 of the fuel injector control system 100 controls the overall operation of the system and generates commands that are applied to the drive circuitry 120. The control circuitry 110 provides appropriate timing or control commands in accordance with a desired time to inject fuel into a corresponding cylinder of the internal combustion engine. The control circuitry 110 preferably generates a signal over line 121 to enable the drive circuitry 120. When a high level signal (i.e., 5 volts) is provided to the drive circuitry 120, the drive circuitry 120 applies power to the solenoid 114. When a logical-low signal is provided to the drive circuitry 120 from the control circuitry 110, power cannot be applied to the solenoid 114.

The drive circuitry 120 of the fuel injection control system 100 controls the operation of the fuel injector 112 in response to control commands provided by the control circuitry 110. The drive circuitry 120 preferably includes a reference source 122 representing a commanded current level, offset circuits 124 and 126, battery and boost comparators 128 and 130 respectively, logical AND gates 132 and 134, gate drives 136 and 138, a boost supply switch 140 and battery-supply switch 142 (preferably solid state MOSFET devices), a battery supply source 144, a boost power supply source 148, a reservoir capacitor 147, a current sensing unit 148, diodes 150 and 152, and a current sense amplifier 154.

The drive circuitry 120 can be divided into first switching circuitry including the battery comparator 128, the logical AND gate 134, the gate drive 138, the battery-supply switch 142, current sensing unit 148, the diode 152, and the current sense amplifier 154. When activated, this first switching circuitry selectively applies a first electrical signal 171, derived from the battery supply source 144, through the battery-supply switch 142, through the diode 152 over line 199, to the solenoid 114 to operate the fuel injector 112. The first electrical signal 171 will be modulated to vary a signal 176 flowing through the solenoid 114 between first maximum and minimum thresholds. When not activated, no voltage will be provided to the solenoid 114 to operate the fuel injector 112 from the battery supply source 144.

The drive circuitry 120 also includes second switching circuitry including the boost comparator 130, logical AND gate 132, gate drive 136, boost-supply switch 140, the current sensing unit 148, and the current sense amplifier 154. When activated, this second switching circuitry selectively applies a second electrical signal 198, derived from the boost power supply source 148, and the reservoir capacitor 147 through the boost-supply switch 140 over line 199 to the solenoid 114 to operate the fuel injector 112. The second electrical signal 198 will be modulated to vary the signal 176 flowing though the solenoid 114 between second maximum and minimum thresholds. When not activated, no voltage will be provided to the solenoid 114 to operate the fuel injector 112 from the boost power supply source 148 or the reservoir capacitor 147.

The reference source 122 of the drive circuitry 120 generates a signal over line 123 to an input of each of the offset circuits 124 and 126. The reference signal is preferably a voltage signal which after scaling by the appropriate gains of the current sense amplifier 154 and the current sense unit 148, corresponds to a commanded nominal load current.

The offset circuits 124 and 126 each receive the reference signal from the reference source 122. The offset circuit 124 provides a battery reference signal $V_{Ref\text{-}Batt}$ over a line 156 through a resistor 125 to a non-inverting input 157 of the battery comparator 128. The offset circuit 126 provides a boost reference signal $V_{Ref\text{-}Boost}$ over a line 158 through a resistor 130 to a non-inverting input 159 of the boost comparator 130.

The feedback resistor 127 is preferably coupled between an output and the non-inverting input 157 of the battery comparator 128, to create the appropriate hysteresis level. The feedback resistor 127, in conjunction with the input resistor 125, develops this hysteresis level for the battery comparator 128. When the output of the battery comparator 128 is logically-high, the voltage level developed at the non-inverting input 157 will be pulled to a battery supply maximum current threshold, preferably the battery reference signal $V_{Ref\text{-}Bat}$ plus one-half the hysteresis of the battery comparator 128. When the output of battery comparator 128 is low, the voltage level developed at the non-inverting input 157 will be pulled to the battery supply minimum current threshold, preferably the battery reference signal $V_{Ref\text{-}Bat}$ minus one-half the hysteresis of the battery comparator 128.

The inverting input of the battery comparator 128 of the drive circuitry 120 receives a sense signal 155 from the current sense amplifier 154. The battery comparator 128 compares the sense signal 155 with the voltage level at the non-inverting input 157. The battery comparator 128 generates an output signal that is supplied over a line 160 to an input of the logical AND gate 134. When the sense signal 155 is less than the voltage level at the non-inverting input 157, the battery comparator 128 provides a high level signal to the logical AND gate 134. When the sense signal 155 is greater than the voltage level at the non-inverting input 157, the battery comparator 128 provides a logical-low signal to the logical AND gate 134.

The feedback resistor 129 is preferably coupled between the output and the non-inverting input 159 of the boost comparator 130, to create the appropriate hysteresis level. The feedback resistor 129, in conjunction with the input resistor 130, develops a hysteresis level for the boost comparator 130. When the output of the boost comparator 130 is logically-high, a voltage level developed at the non-inverting input 159 will be pulled to a boost power supply maximum current threshold, preferably the boost reference signal $V_{Ref\text{-}Boost}$ plus one-half the hysteresis of the boost comparator 130. When the output of the boost comparator 130 is low, the voltage level developed at non-inverting input 159 will be pulled to the boost power supply minimum current threshold, preferably the boost reference signal $V_{Ref\text{-}Boost}$ minus one-half the hysteresis of the boost comparator 130.

The boost comparator 130 receives a sense signal 155 from the current sense amplifier 154. The boost comparator 130 compares the sense signal 155 with the voltage level at the non-inverting input 159. The boost comparator 130 generates an output signal that is supplied over a line 162 to an input of the logical AND gate 132. When the sense signal 155 is less than the voltage level at the non-inverting input 159, the boost comparator 130 provides a high level signal to the logical AND gate 132. When the sense signal 155 is greater than the voltage level at the non-inverting input 159, the boost comparator 130 provides a logical-low signal to the logical AND gate 132.

The logical AND gate 134 of the drive circuitry 120 receives the output signal from the battery comparator 128, and the logical AND gate 132 receives the output signal from boost comparator 130. Each of the logical AND gates 132 and 134 also receives a signal over line 121 from the control circuitry 110. Each of the logical AND gates 132 and 134 can be controlled independently by the control circuitry 110. The logical AND gate 132 provides an output signal over a line 166 to the gate drive 136, and the logical AND gate 134 provides an output signal over a line 168 to the gate drive 138.

The gate drive 136 receives the output signal from the logical AND gate 132. The outputs of the gate drive 136 are coupled to the gate and source of the boost-supply switch 140. The gate drive 136 supplies sufficient current and voltage over lines 170 and 174 to activate boost-supply switch 140. When the gate drive 136 is activated, the gate drive 136 turns on the boost-supply switch 140 to apply voltage from the boost power supply source 148 and the reservoir capacitor 147 to the solenoid 114.

The boost-supply switch 140 permits power from the boost power supply source 148 and the reservoir capacitor 147 to be selectively applied to the solenoid 114. When the boost-supply switch 140 is activated, the boost voltage signal $V_{Boost}$ 198 is provided by the boost power supply source 148 and the reservoir capacitor 147 to the solenoid 114. The boost power supply source 148 preferably supplies a relatively high positive voltage, such as, for example, about 100 volts DC signal, over line 199 to the solenoid 114. When the boost-supply switch 140 is deactivated, the boost power supply source 148 and the reservoir capacitor 147 are disconnected from the solenoid 114.

The boost power supply source 148 preferably comprises a switched-mode power supply including a DC-to-DC converter and a converter control circuit (not shown). The switched-mode power supply converts the nominal 12 volts DC signal $V_{battery}$ supplied by the battery supply source 144 to a nominal 100 volts DC signal to charge the boost power supply reservoir capacitor 147. The boost power supply source 148 can include any suitable device to generate a high voltage signal.

The gate drive 138 receives the output signal from the logical AND gate 134. The outputs of the gate drive 138 are coupled to the gate and source of the battery-supply switch 142. The gate drive 138 supplies sufficient current and voltage over lines 172 and 173 to activate battery-supply switch 142. When the gate drive 138 is activated, the gate drive 138 turns on the battery-supply switch 142 to apply the voltage from the battery supply source 144 to the solenoid 114.

The battery-supply switch 142 permits power from the battery supply source 144 to be selectively applied through the diode 152 to the solenoid 114. When the battery-supply switch 142 is activated, the battery voltage signal $V_{battery}$ is provided by the battery supply source 144 to the solenoid 114. The battery supply source 144 preferably supplies a nominal 12 volts DC signal over line 199. When the battery-supply switch 142 is deactivated, the battery supply source 144 is disconnected from the solenoid 114.

The diode 152 is preferably coupled between the source of the battery-supply switch 142 and a terminal 175. The diode 152 prevents reverse current flow through the battery-supply switch 142 when the boost-supply switch 140 is activated. In addition, the diode 152 allows both switches 140 and 142 to be gated on simultaneously without discharging the reservoir capacitor 147 into the battery supply source 144. The diode 150 is preferably coupled between the terminal 175 and battery ground. The diode 150 allows current to flow from the solenoid 114 to battery ground when both the switches 140 and 142 are deactivated. This current flow represents a third electrical signal 178. The diode 150 can also be coupled to a third supply source to apply current flow to the solenoid 114.

The current sensing unit 148 senses the current 176 flowing through the solenoid 114 and provides an output signal indicative of the current flow to the current sense amplifier 154. The current sensing unit 148 preferably comprises a sense resistor, hall effect device, or other current measurement mechanism. The current sense amplifier 154 receives an output signal from the current sensing unit 148 and provides the sense signal 155 to the inverting input of each of the comparators 128 and 130. A low-side switch 177 may be coupled between the solenoid 114 and the current sensing unit 148.

When the boost-supply switch 140 and/or battery-supply switch 142 are/is actively turned on, and a control command is provided to the drive circuitry 120 from the control circuitry 110, voltage is applied to the solenoid 114 to cause the solenoid 114 to actuate and thereby inject fuel into the corresponding cylinder of the internal combustion engine. When the sense signal 155 of the current sense amplifier 154 falls below a minimum battery current threshold at the non-inverting input 157 of the battery comparator 128, the battery comparator 128 will cause the battery-supply switch 142 to activate, applying voltage from battery supply source 144 to the fuel injector solenoid 114. The battery-supply switch 142 will deactivate when the sense signal 155 of the current sense amplifier 154 reaches a maximum battery current threshold applied at the non-inverting input 157 of the battery comparator 128.

When the sense signal 155 of the current sense amplifier 154 reaches a minimum boost current threshold at the non-inverting input 159 of the boost comparator 130, the boost comparator 130 will cause the boost-supply switch 140 to activate, applying voltage from the boost power supply source 148 and the reservoir capacitor 147 to the solenoid 114. The boost-supply switch 140 will deactivate when the sense signal 155 of the current sense amplifier 154 reaches a maximum boost current threshold applied to the non-inverting input 159 of the boost comparator 130.

Figure 2:
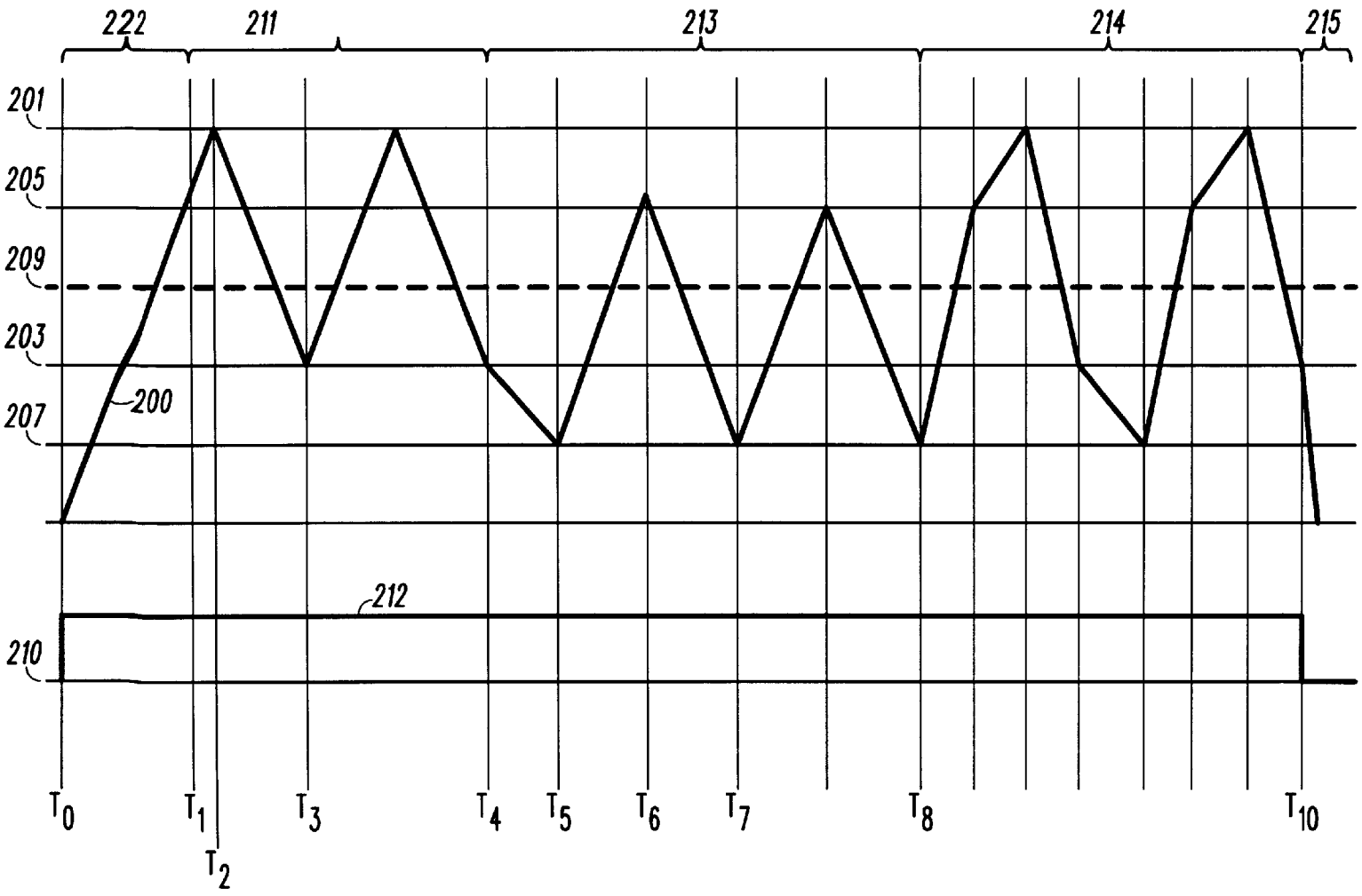
FIG. 2 is a graph illustrating a portion of a fuel injector current waveform of the fuel injection control system of FIG. 1.

The operation of the fuel injection control system 100 of FIG. 1 will now be discussed in conjunction with the current waveform shown in FIG. 2. The vertical axis of these waveforms represents the magnitude of the current flowing through the fuel injector solenoid 114 and the horizontal axis represents time. Reference number 201 denotes a maximum battery current threshold $I_{max\text{-}bat}$ which will be associated with a first maximum threshold; reference number 203 denotes a minimum battery current threshold $I_{min\text{-}bat}$ which is associated with a first minimum threshold; reference number 205 denotes a maximum boost current threshold $I_{max\text{-}boost}$ which will be associated with a second maximum threshold; reference number 207 denotes a minimum boost current threshold $I_{min\text{-}boost}$ which is associated with a second minimum threshold; and reference number 209 denotes a nominal, or average current threshold $I_{nom}$. FIG. 2 is separated into five regions for illustration of 5 different drive conditions.

During a first period 212 (Mode I—Initial Rise Time), occurring time $T_0$ to $T_1$, the control circuitry 110 commands a rapid pull-in of the solenoid 114. At this time the initial solenoid current 176 is zero or some very low value below all of the thresholds. Also, at this time voltage output available from the battery supply source 144 is not sufficiently high enough to actuate the solenoid as rapidly as desired. This is primarily due to design tradeoffs in the design of the solenoid and the available battery voltage. Both the battery supply switch 142 and the boost supply switch 140 will be gated "on", however, the diode 152 will prevent discharge of the boost capacitor into the battery supply through the battery supply switch 142. Effectively the boost supply voltage signal 198 is applied to the solenoid 114 and the current increases. Signal 200 represents the current flowing through the fuel injector solenoid 114 which will begin to rise after time $T_0$. Mode I ends when current 176 increases above the second maximum threshold 205. At this point the boost supply switch 140 is gated "off" and the battery supply switch remains "on". The system proceeds to mode II, III or IV, depending on the instantaneous voltage of the battery supply and the load conditions.

During a second period 211 (Mode II—High Battery), located between time $T_1$ and $T_4$, the control circuitry 110 continues to demand energy to be supplied to the solenoid 114. The voltage output available from the battery supply source 144 is sufficient to maintain the commanded current level. Boost supply switch 140 remains "off", and battery supply switch 142 is gated "on" and "off" to modulate the solenoid current 176 between first maximum threshold 201 and first minimum threshold 203. During this mode of operation, solenoid current 176 never decreases to the second minimum threshold 207, and the boost supply switch 142 is never gated "on". Here the signal 200 will be modulated between the first maximum threshold 201 and the first minimum threshold 203.

During a third period 213 (Mode III—Low Battery), located between $T_4$ and $T_8$, the control circuitry continues to demand energy to be supplied to the solenoid 114, but now the voltage output available from the battery supply source 144 is not sufficient to maintain the commanded current level. Battery supply switch 142 remains "on", and the boost supply switch 140 is gated "on" and "off" to modulate the solenoid current 176 between the second maximum threshold 205 and the second minimum threshold 207. During this mode of operation, solenoid current 176 never increases to the first maximum threshold 201, and the battery supply switch 140 is "never" gated "off". Here the signal 200 will be modulated between the second maximum threshold 205 and the second minimum threshold 207.

During a fourth period 214 (Mode IV—Varying Battery and Boost Voltages), located between $T_8$ and $T_{10}$, the control circuitry 110 continues to demand energy to be supplied to the solenoid 114. However, the instantaneous battery supply and boost supply voltages are varying significantly and operation may be required in both Modes II and III within a given switching cycle. At any given instant there may or may not be sufficient battery voltage to increase the solenoid current 176 to the first maximum threshold 201, and thus the battery supply switch 142 may or may not be gated "off". Likewise there may or may not be sufficient battery supply voltage to maintain the "commanded" current level, and as such, the solenoid current 176 may or may not decrease to the second minimum threshold 207, and the boost supply switch may or may not be gated "on". During this mode the control system 120 will modulate the solenoid current 176 between either the first or second maximum thresholds 201 or 205, respectively and either the first or second minimum thresholds 203 or 207, respectively. Thus the fuel injector control system 120 will maximize the amount of energy drawn from the battery supply 144 and minimize the amount of energy drawn from the boost supply 148. Here the signal 200 will be maintained between the first maximum threshold 201 and the second minimum threshold 207.

During a fifth period 215 (Mode V—Current Decay), located after T10, the control circuit 110 provides a low signal to the logical AND gates 132 and 134 to disable the boost supply switch 140 and the battery supply switch 142. The current control circuitry of 120 does not apply during this mode and the solenoid current 176 will decay to zero. Note that system impedances in combination with available battery voltage can determine the need for augmented drive by the boost-supply switch 140 and its energy reserves, the boost power supply source 148, and the reservoir capacitor 147. System impedances can include any impedance caused by a circuit in series with current flowing through the solenoid 114. What is "sufficiently high" and "sufficiently low" depends on the application; and more specifically can be in part determined dependent on a minimum specified time between fuel injection events and the size of the reservoir capacitor.

Now specifics of the circuit mechanics will be detailed. Control signal 210 is provided to the drive circuitry 120 of the fuel injection control system 100 of FIG. 1. Prior to time $T_0$, a low signal level is provided from the control circuitry 110 to the drive circuitry 120. As a result, the switches 140 and 142 will be deactivated, preventing provision of voltage from the battery supply source 144, the boost power supply source 148, and/or the reservoir capacitor 147 to the solenoid 114. It is further assumed that any initial current flowing through the fuel injector solenoid 114 is at an essentially zero value just prior to time $T_0$.

At time $T_0$, a positive command signal 212 is generated for a predetermined time to effect actuation of the fuel injector solenoid 114. In response to a leading edge of the command signal 212, the switches 140 and 142 will activate and connect the boost power supply source 148, the reservoir capacitor 147, and the battery supply source 144 to the solenoid 114. At this point, the diodes 150 and 152 will both be conducting. Diode 150 is blocking provision of voltage from the battery supply source 144 because the voltage of the boost power supply source 148 and the reservoir capacitor 147 will be significantly greater than the battery supply voltage and will thus reverse bias the diode 152.

As the current through the fuel injector solenoid 114 rises, illustrated by signal 200, a voltage level at the inverting inputs of the comparators 128 and 130 will increase. The comparators 128 and 130 continuously compare the voltage level at the non-inverting inputs to the sense signal $V_S$ 155 at the inverting inputs of the comparators 128 and 130. Since the outputs of the comparators 128 and 130 are initially at a high level, feedback resistors 127 ands 129 cause the voltage at the non-inverting inputs of the comparators 128 and 130 to be pulled to the maximum battery current threshold $I_{max\text{-}bat}$ 201 and the maximum boost current threshold $I_{max\text{-}boost}$ 205, respectively.

As the current increases through the solenoid 114, the voltage level at the inverting input of the boost comparator 130 will pass the maximum boost current threshold $I_{max\text{-}boost}$ 205 being maintained at the non-inverting input 159 of the boost comparator 130 causing the output of the comparator 130 to go low at time $T_1$. This is readily visualized FIG. 2 by the signal 200 exceeding a current level corresponding to a maximum boost current threshold $I_{max\text{-}boost}$ 205. In response to the low output of the boost comparator 130, the boost-supply switch 140 will be deactivated, thereby disconnecting the boost power supply source 148 and the reservoir capacitor 147 from the solenoid 114. The voltage level at the non-inverting input 159 of the boost comparator 130 will now be pulled to the minimum boost current threshold $I_{min\text{-}boost}$ 207.

Subsequently, the current flowing through the solenoid 114 will commutate from the boost-supply switch 140 to the battery-supply switch 142 and the diode 152. The forward conduction of the battery-supply switch 142 and the diode 152 will apply the voltage of the battery supply source 144 to the fuel injector solenoid 114. As a result, the current flowing through the fuel injector solenoid 114 will continue to increase until the current reaches the maximum battery current threshold being maintained at the non-inverting input 157 of the battery comparator 128, causing the output of the battery comparator 128 to go low at time $T_2$. In response to the low output produced by the battery comparator 128, the battery-supply switch 142 will be deactivated effectively disconnecting the battery supply source 144 from the fuel injector solenoid 114. The voltage at the non-inverting input 157 of the battery comparator 128 will now be pulled to the minimum battery current threshold. When the battery-supply switch 142 is deactivated, the current flowing through the fuel injector solenoid 114 will commutate from the battery-supply switch 142 and the diode 152 to the recirculation diode 150.

Thereafter, the fuel injector current begins to decrease as is generally illustrated by the reduction in the signal 200. This reduction of injector current continues until the voltage level at the inverting input of the battery comparator 128 falls below the voltage level at the non-inverting input of the battery comparator 128 at time $T_3$. At this point, the comparator 128 will produce an output signal to turn the battery-supply switch 142 on, closing the connection between the battery supply source 144 and the solenoid 114 to increase the injector solenoid current. When battery-supply switch 142 is activated, the fuel injector solenoid current will commutate from the recirculation diode 150 to the battery-supply switch 142 and the diode 152. The diode 150 will then be blocking while the diode 152 and the battery-supply switch 142 will be conducting. This type of operation continues cyclically as long as the battery supply source 144 can apply sufficient voltage to increase the current flowing in the solenoid 114. Thus, during time period $T_2$ to $T_4$, the fuel injector current cyclically varies between the maximum and minimum battery current thresholds $I_{max\text{-}bat}$ and $I_{min\text{-}bat}$. Furthermore, this operation will continue as long as the voltage level of the battery supply source 144 is sufficient to maintain the fuel injector solenoid current above the minimum battery threshold $I_{min\text{-}bat}$. Next, at time $T_4$, the battery-supply switch 142 is activated, however, the battery supply source 144 is unable to increase the current flowing through the solenoid 114. As a result, the current level decreases as is generally illustrated by the reduction in the signal 200. This reduction in the solenoid current continues until the voltage level at the inverting input of the boost comparator 130 reaches the voltage level at the non-inverting input 159 of the boost comparator 130 at time $T_5$. During the period $T_4$ to $T_5$, the diode 152 will be conducting and the diode 150 will be blocking.

Then, at time $T_5$, the boost comparator 130 produces an output signal to activate boost-supply switch 140, closing the connection between the solenoid 114 and the boost power supply source 148 and the reservoir capacitor 147. As a result, the current will begin to increase and the diodes 150 and 152 will be blocking. When the current reaches the maximum boost current threshold $I_{max\text{-}boost}$ 205 at $T_6$, the boost-supply switch 140 will deactivate and the current will begin to decrease. At this point, the battery-supply switch 142 and the diode 152 are conducting and the diode 150 is blocking.

When the current reaches the minimum boost current threshold $I_{min\text{-}boost}$ at $T_7$, the boost-supply switch 140 is activated to increase the current through the solenoid 114 as described above. This type of operation continues cyclically as long as the battery supply source 144 does not apply sufficient voltage to increase the current flowing in the solenoid 114 to the maximum battery current threshold $I_{max\text{-}bat}$. During time $T_4$ to $T_8$, the battery-supply switch 142 remains on and the fuel injector current cyclically varies between the maximum and minimum boost current thresholds $I_{max\text{-}boost}$ and $I_{min\text{-}boost}$ as shown in FIG. 2.

During the boost-hold mode occurring between time $T_8$ to time $T_{10}$, the boost-supply switch 140 and battery-supply switch 142 are activated and deactivated and the current cycles between the maximum battery current threshold $I_{max\text{-}bat}$ and the minimum boost current threshold $I_{min\text{-}boost}$. This last mode of operation occurs when either the battery or boost power supply sources are in transient states, in which either of these voltages varies from one cycle to the next, thereby determining which set of levels the fuel injector solenoid current swings between.

Figure 3:
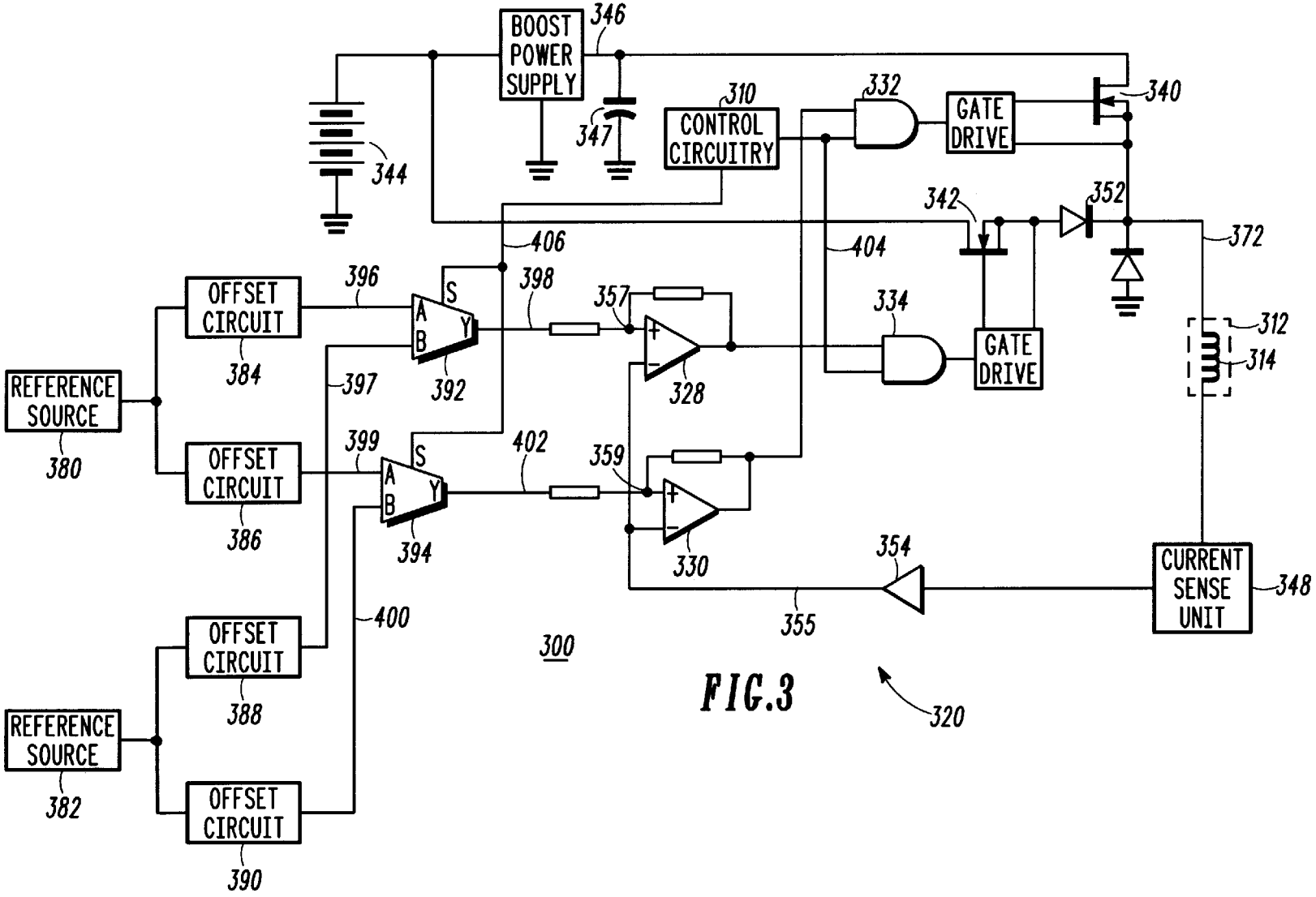
FIG. 3 is another schematic diagram of a fuel injection control system associated with a fuel injection of an internal combustion engine, providing a pull-in period of time and a holding period of time.
Figure 4:
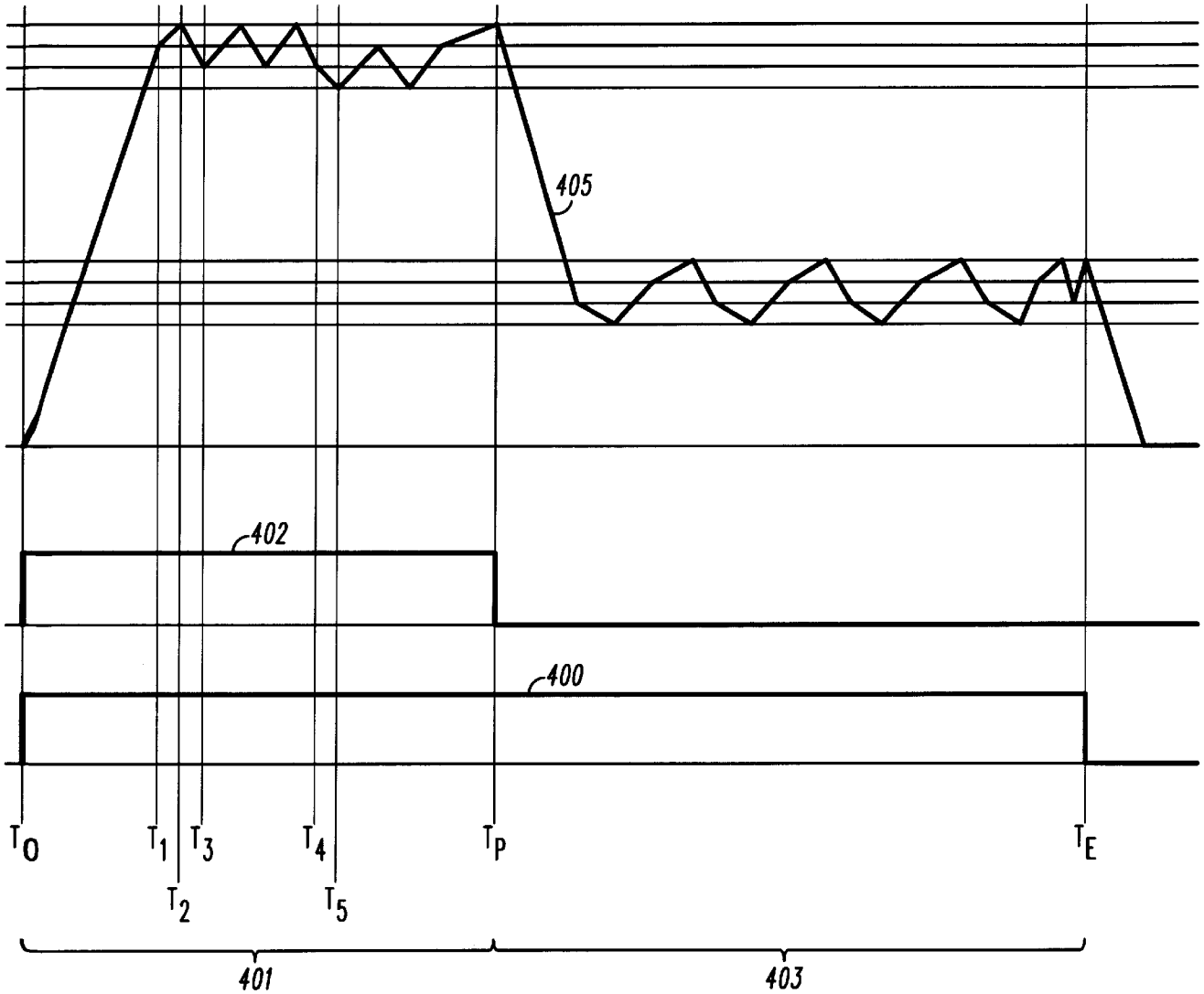
FIG. 4 is a graph illustrating a portion of a command signal and a fuel injection current waveform the fuel injection control system of FIG. 3.

FIG. 3 and FIG. 4 show and alternative embodiment to that shown in FIG. 1 and FIG. 2. The alternative embodiment shows application of the four thresholds at two different average current levels.

Referring now to FIG. 3, a schematic diagram of a fuel injector control system 300 for use in conjunction with an internal combustion engine (i.e., a spark ignition engine, a diesel engine, etc.) is illustrated. The fuel injection control system 300 provides a high current to a solenoid 314 of a fuel injector 312 during a pull-in period of time to achieve initial actuation of a solenoid 314 and provides a smaller magnitude current to the solenoid 314 to maintain actuation of the fuel injector 312 during a subsequent holding or hold period of time. Although only one fuel injector 312 is illustrated, the fuel injection control system 300 can be designed to control the operation of any suitable number of fuel injectors.

During the operation of the fuel injector 312, the fuel injection control system 300 selectively provides a battery voltage signal $V_{battery}$ and a boost voltage signal $V_{Boost}$ 346 to the fuel injector 312. During the pull-in 401 and hold 403 periods, the battery voltage signal is applied to the solenoid 314 when the current flowing through the solenoid 314 falls below a minimum battery current threshold $I_{min\text{-}bat}$, and the battery voltage signal is disconnected from the solenoid 314 when the current flowing though the fuel injector solenoid reaches a maximum battery current threshold $I_{max\text{-}bat}$. Thus, the battery voltage signal $v_{battery}$ varies the current between the maximum and minimum battery current thresholds during both of the pull-in 401 and hold periods 403.

In addition, the boost voltage signal $V_{Boost}$ 346 can be applied when the current flowing through the solenoid 314 reaches a minimum boost current threshold $I_{min\text{-}boost}$, and the boost voltage signal is deactivated when the current reaches a maximum boost current threshold $I_{max\text{-}boost}$ 205 during both of the pull-in and hold periods. Furthermore, the boost voltage signal $V_{boost}$ 346 is used to assist the battery voltage signal $V_{battery}$ to provide the solenoid 314 with adequate operating current for when the battery voltage is abnormally low, including when the engine is cranking.

As shown in FIG. 3, the fuel injection control system 300 includes injector control circuitry 310 and drive, or waveform control, circuitry 320. Although the fuel injection control system 300 is shown as being constructed with various types of independent and separate units or devices, the fuel injection control system 300 can be implemented by one of more integrated circuits, or a microprocessor or microcontroller which may be programmed to execute the operations or functions equivalent to those performed by the circuits or units shown. It will also be recognized that the system can be carried out in the form of hardware components and circuit designs, software or computer programming, or a combination thereof.

The control circuitry 310 and drive circuitry 320 corresponds in many respects in function and construction to the previous described fuel injector control system 100 of FIG. 1. As shown in FIG. 3, the drive circuitry 320 further includes reference sources 380 and 382, offset circuits 384, 386, 388 and 390, and multiplexers 392 and 394. Components of the fuel injection control system 300 which generally correspond to those components of the fuel injector system 100 of FIG. 1 are designated as like numbers in the three-hundred series.

The drive circuitry 320 of the fuel injection system 300 provides an effective pull-in current to the solenoid 314 in response to a command signal from the control circuitry 310 to provide a predetermined pull-in time which is independent of the magnitude of the injector current. The drive circuitry 320 provides maximum and minimum boost and battery current thresholds for the solenoid 314 during the predetermined pull-in period and provides maximum and minimum boost and battery current thresholds during the hold period.

The reference source 380 of the drive circuitry 320 provides a reference signal to an input of each of the offset circuits 384 and 386. The reference source 380, when scaled by the appropriate gains of the currents sense unit 348 and current sense amplifier 354, corresponds to a nominal commanded pull-in current. The reference source 382 of the drive circuitry 320 provides a reference signal to an input of each of the offset circuits 388 and 390. The reference source 382 corresponds to a nominal commanded hold current when scaled by the appropriate gains of the currents sense unit 348 and current sense amplifier 354.

The offset circuit 384 provides a battery pull-in reference signal over a line 396 to input A of the multiplexer 392, and the offset circuit 388 provides a battery hold reference signal over a line 397 to input B of the multiplexer 392. When input S of the multiplexer 392 receives a high level signal, the multiplexer 392 selects input A as the output to provide over a line 398 to the non-inverting input 357 of the battery comparator 328. When input S of the multiplexer 392 receives a logical-low signal, the multiplexer 392 selects input B as the output to provide over the line 398 to the non-inverting input 357 of the battery comparator 328.

The offset circuit 386 provides a boost pull-in reference signal over a line 399 to input A of the multiplexer 394, and the offset circuit 390 provides a boost hold reference signal over a line 400 to input B of the multiplexer 394. When input S of the multiplexer 394 receives a high level signal, the multiplexer 394 selects input A as the output to provide over a line 402 to the non-inverting input 359 of the boost comparator 330. When input S of the multiplexer 394 receives a logical-low signal, the multiplexer 394 selects input B as the output to provide over the line 402 to the non-inverting input 359 of boost comparator 330.

The operation of the fuel injection control system 300 of FIG. 3 will now be discussed in conjunction with the circuit waveforms shown in FIG. 4.

Control signal 400 is provided from the control circuitry 310 of the fuel injection control system 300 and controls the total duration of the fuel injector actuation time. Control signal 402 provided from the control circuitry 310 of the fuel injection control system 300 which controls the duration of the pull-in period of the fuel injector actuation time. Note that the pull-in period is defined here to occur between $T_0$ and $T_P$, as shown by reference number 401, and the hold period is defined here to occur between $T_P$ and $T_E$, as shown by reference number 403.

Prior to an initial time $T_0$, a low control signal level is provided by the control circuitry 310 to the drive circuitry 310. As a result, the switches 340 and 342 will be deactivated, preventing voltage from the battery supply source 344, the boost power supply source 346, and the reservoir capacitor 347 from being applied to the solenoid 314.

At time $T_0$, the control circuitry 310 produces two positive command signals 400 and 402, both of predetermined lengths which provide actuation of the solenoid 314 of the fuel injector 312. The first signal 400 controls the total duration of solenoid actuation, while the second signal 402 determines the duration of the pull-in period, which is typically shorter than or equal to the total duration of the solenoid actuation. During the pull-in time period, relatively high current preferably flows through the solenoid 314 to ensure a rapid response of the mechanical actuation of the fuel injector 312. Subsequently, during the hold period, a lower level of current preferably flows through the solenoid 314 to minimize power dissipation and improve overall energy efficiency of the system. During the hold period, the pull-in signal 402 is at a low level.

At the time $T_0$, there is no current flowing in the solenoid 314 and, therefore, the sense signal $V_S$ 355 provided by the current sense amplifier 354 is at a low level. The sense signal $V_S$ 355 is provided to the inverting input of the comparators 328 and 330. Prior to $T_0$, the comparators 328 and 330 produce a high output to the logical NAND gates 332 and 334 because of the magnitude of the sense signal $V_S$ 355. When the control circuitry 310 provides a high level command signal over line 404 at $T_0$, the logical NAND gates 332 and 334 are enabled and the switches 340 and 342 are activated. This action results in effectively closing switches 340 and 342 which connect the boost power supply source 346, the reservoir capacitor 347. The diode 352 prevents current flow into the battery. As the current through the solenoid 314 rises, the sense signal $V_S$ 355 provided to the inverting inputs of the comparators 328 and 330 will increase.

During the pull-in period, corresponding to the time period $T_0$ to $T_P$, the control circuitry 310 provides a high level signal over the line 406 that selects input A of each of the multiplexers 392 and 394 as the outputs over lines 398 and 402, respectively. Thus, the offset reference 384 is providing a pull-in battery reference signal to the non-inverting input 357 of the battery comparator 328, and the offset circuit 386 is providing a pull-in boost reference signal to the non-inverting input 359 of the boost comparator 330.

As the current in the fuel injector increases, the sense signal $V_S$ 355 of the current sense amplifier 354 will pass the maximum boost current threshold $I_{max\text{-}boost}$ 205 being maintained at the non-inverting input 359 of the boost comparator 330 at time $T_1$. As a result, the output of the boost comparator 330 will go low to deactivate switch 340, disconnecting the boost power supply source 346 and the reservoir capacitor 347 from the solenoid 314. The voltage level at the non-inverting input 359 of the boost comparator 330 will be pulled to a minimum boost pull-in current threshold as a result of the low level output of the boost comparator 330.

Subsequently, the current through the fuel injector solenoid 314 will continue to increase until the current reaches a maximum battery pull-in current threshold $I_{max\text{-}bat}$ at $T_2$. At which point the sense signal $V_S$ 355 will reach the maximum battery pull-in current threshold being maintained at the non-inverting terminal 357 of the battery comparator 328. In response to the low output produced by the comparator, the switch 342 will be deactivated, thereby disconnecting the battery supply source 344 from the fuel injector solenoid 314. Thereafter, the current begins to decrease as is generally illustrated by the reduction in the signal 405 .

This reduction in current continues until the voltage level at the inverting input of battery comparator 328 falls below the minimum battery pull-in current threshold maintained at the non-inverting input 357 of the battery comparator 328 at time $T_3$. At this time, the battery comparator 328 will produce a high output signal to turn the switch 342 on, closing the connection between the battery supply source 344 and the solenoid 314 to increase the current through the solenoid 314. This type of operation can continue cyclically until the end of the pull-in period. However, as shown by the behavior of signal 405 in FIG. 5, the switch 342 is activated at time $T_4$, but the battery supply source 344 is unable to increase the current flowing through the solenoid 314. As a result, the current level continues to decrease until the voltage level at the inverting input of the boost comparator 330 falls below the minimum boost pull-in current threshold maintained at the non-inverting input 359 of the boost comparator 330 at time $T_5$.

At the time $T_5$, the boost comparator 330 produces a high output level signal to turn the switch 340 on, closing the connection between the boost power supply source 346 and the reservoir capacitor 347 and the solenoid 314 to increase the current. This type of operation continues cyclically as long as the battery supply source 344 is unable to apply sufficient voltage to increase the current flow through the solenoid 314. Thus, during this time period, the current can vary between the maximum and minimum boost pull in current thresholds $I_{max\text{-}boost}$ and $I_{min\text{-}boost}$. Likewise, during this time period, the fuel injector solenoid current can vary between the pull-in maximum and minimum battery pull in current thresholds $I_{max\text{-}boost}$ and $I_{min\text{-}boost}$, or the fuel injector solenoid current can vary anywhere between these thresholds (i.e., between the maximum battery pull in current threshold $I_{max\text{-}bat}$ and the minimum boost pull-in current threshold $I_{min\text{-}boost}$).

During the hold period time which exist from the time $T_P$ to the time $T_E$, the nominal current through the fuel injector solenoid preferably has a smaller magnitude than the nominal current during the pull-in period. The drive circuitry 320 provides holding maximum and minimum battery current thresholds $H_{max\text{-}bat}$ and $H_{min\text{-}bat}$, and holding maximum and minimum boost current thresholds $H_{max\text{-}boost}$ and $H_{min\text{-}boost}$ for the injector current illustrated in FIG. 2 Thus, during the holding period, again the injector current will vary cyclically due to the operation of the comparators, but now the maximum and minimum boost and battery current thresholds for the fuel injector solenoid current are significantly lower than the corresponding maximum and minimum boost and battery current thresholds provided during the previous pull-in period.

During the hold period time, the control circuitry 310 provides a logical-low signal over a line 406 to each input S of the multiplexers 392 and 394. As a result, each of the multiplexers 392 and 394 selects input B as the output to be provided over lines 398 and 402 to the non-inverting inputs of comparators 328 and 330, respectively. Thus, a hold battery current threshold is applied to the battery comparator 328, and a hold boost current threshold is applied to boost comparator 330. As a result, the current through the fuel injector will vary between the maximum and minimum hold battery current thresholds when the battery supply source 344 is sufficient to increase the fuel injector current, and the current will vary between the maximum and minimum hold boost current thresholds when the battery supply source 344 is insufficient to increase the fuel injector solenoid current as described.

Figure 5:
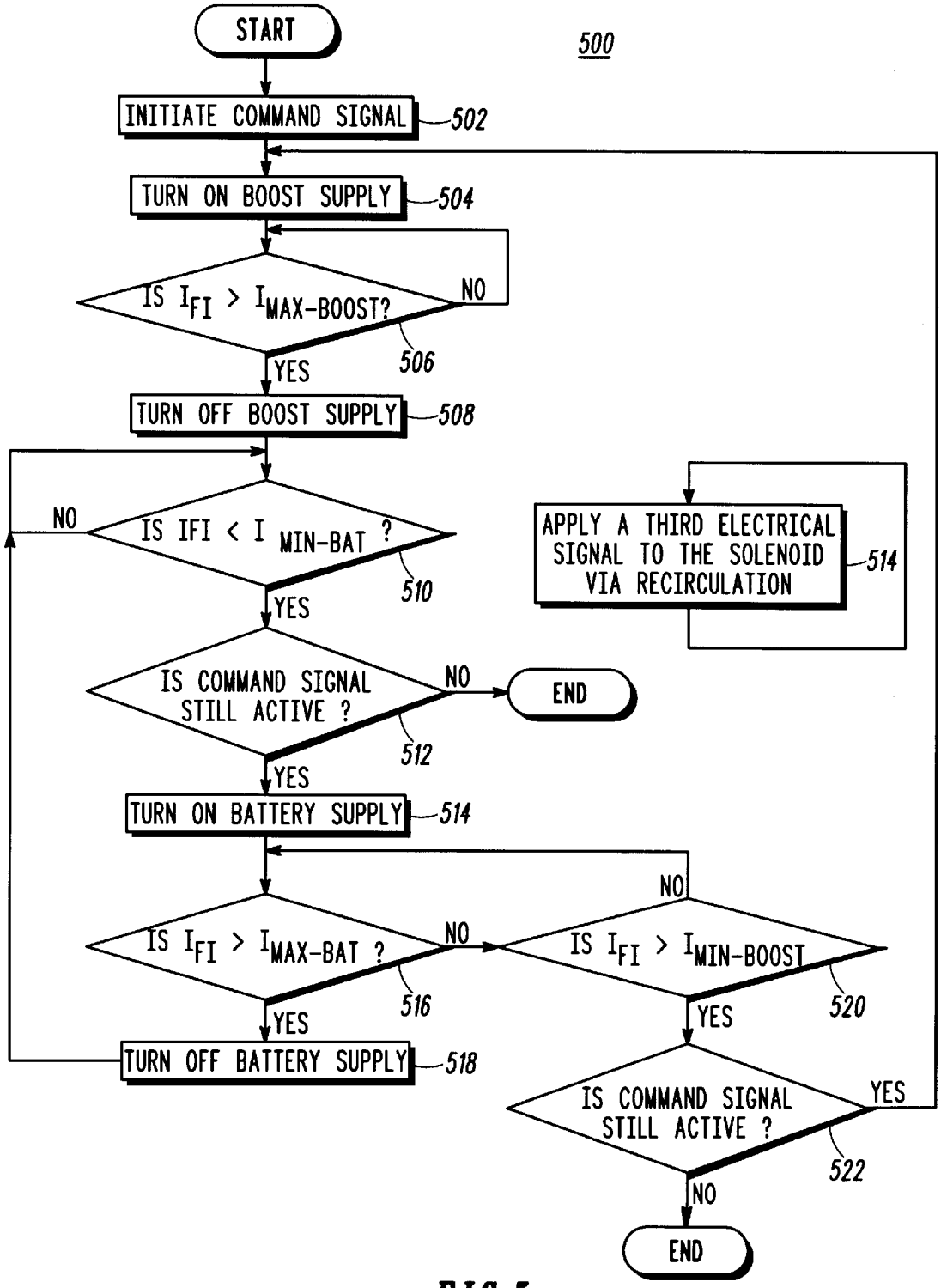
FIG. 5 is a flow chart of a method to actuate a fuel injector.

Referring now to FIG. 5, a flow chart of a routine to actuate a fuel injector is illustrated. At block 502, the system initiates a command signal, and a boost power supply is activated at block 504. The boost power supply applies a voltage signal to increase the current $I_{FI}$ flowing through the fuel injector. It is also contemplated that a battery signal may also be initially applied to the fuel injector along with the boost power supply voltage during an initial actuation period.

At block 506, the system determines whether the fuel injector current $I_{FI}$ has reached a maximum boost current threshold $I_{Max\text{-}Boost}$ 205. If the fuel injector current $I_{FI}$ is greater than the maximum boost current threshold $I_{Max\text{-}Boost}$ 205, the system will deactivate the boost power supply at block 508. The system then determines whether the fuel injector current $I_{FI}$ has fallen below a minimum battery current threshold $I_{Min\text{-}Bat}$ at block 510. If the fuel injector current $I_{FI}$ is less than the minimum battery current threshold $I_{Min\text{-}Bat}$, the system will determine if the command signal is still active at block 512. If the command signal is not active, the routine will end. If the command signal is active, the system will activate the battery supply at block 514.

At block 516, the system determines whether the fuel injector current $I_{FI}$ has reached a maximum battery current threshold $I_{Max\text{-}Bat}$. If the fuel injector current $I_{FI}$ is greater than the maximum battery current threshold $I_{Max\text{-}Bat}$, the system will deactivate the battery supply at block 518 and the process will proceed to block 510 as described above. If the fuel injector current $I_{FI}$ is not greater than the maximum battery current threshold $I_{Max\text{-}Bat}$ at block 516, the system determines whether the fuel injector current $I_{FI}$ has fallen below a minimum boost current threshold $I_{Min\text{-}Boost}$ at block 520. If the fuel injector current $I_{FI}$ is less than the minimum boost current threshold $I_{Min\text{-}Boost}$, the system will determine if the command signal is still active at block 522. If the command signal is not active, the routine will end. If the command signal is active, the system will activate the boost power supply at block 524 and the process will proceed to block 506 as described above. Step 555 is initiated when ever recirculation is in effect.

The apparatus and method of the present invention can vary the current through a fuel injector between maximum and minimum boost current thresholds and between maximum and minimum battery current thresholds. This is accomplished by selectively applying power from a boost power supply source and a battery supply source to the fuel injector. The apparatus and method can be readily implemented in an integrated circuit design and provide circuit design flexibility to set maximum and minimum battery and boost current thresholds.

An improved approach for driving loads, solenoids in particular, that will operate under low battery voltage to supplement the drive provided by the battery has been detailed here. The application of this control method and circuitry can be applied to any type of inductive electrical load, in addition to the fuel injector shown here. Examples include loads where one which might require peak and sustain type of current drive (i.e., a single leg or phase of a switched reluctance or stepper motor) can be derived from the embodiments described herein.

What is claimed is:

1. A circuit to actuate a load comprising:

first switching circuitry to selectively apply a first electrical signal to the load to vary a load signal between a first maximum threshold and a first minimum threshold; and second switching circuitry to selectively apply a second electrical signal to the load to vary the load signal between a second maximum threshold and a second minimum threshold, the second electrical signal having a magnitude substantially higher than the first electrical signal, wherein the second minimum threshold has a magnitude less than the magnitude of the first minimum threshold.

2. A circuit in accordance with claim 1 wherein the load comprises a solenoid.

3. A circuit in accordance with claim 1 wherein the load signal is indicative of the current flowing through the load.

4. A circuit in accordance with claim 1 wherein the second maximum threshold has a magnitude less than a magnitude of the first maximum threshold and greater than a magnitude of the first minimum threshold.

5. A circuit in accordance with claim 1 wherein the load signal varies cyclically between the second minimum threshold and the second maximum threshold, when the first electrical signal is insufficient to maintain the load signal above the first minimum threshold.

6. A circuit in accordance with claim 1 wherein the first electrical signal is provided by a battery.

7. A circuit in accordance with claim 1 wherein the second electrical signal is provided by a boost voltage source derived from the battery, the second electrical signal having a substantially higher voltage level than the first electrical signal.

8. A circuit in accordance with claim 1 further comprising a third electrical signal provided to the load by a diode coupled to the load.

9. A circuit in accordance with claim 2 wherein the first electrical signal and second electrical signal are applied during one of a pull-in time and a hold time.

10. A fuel injection control system to energize a fuel injector solenoid using a boost power supply source and a battery supply source comprising:

a first switching circuit to selectively apply a battery voltage signal, derived from the battery supply source, to the fuel injector solenoid;

a first comparator and driving circuit to compare a sense signal, indicative of current flowing through the fuel injector solenoid, to a first battery supply current level threshold, and to enable the first switching circuit dependent thereon;

a second switching circuit to selectively apply a boost voltage signal from the boost power supply source to the fuel injector solenoid;

a second comparator and driving circuit to compare the sense signal to a first boost current level threshold, and to enable the second switching circuit dependent thereon.

11. A circuit in accordance with claim 10 wherein the battery voltage signal provided by the first switching circuit varies between the first battery supply current level threshold, and a second battery supply current level threshold, and the boost voltage signal provided by the second switching circuit varies between the first boost current level threshold and a second boost current level threshold, and wherein the first boost current level threshold has a magnitude less than a magnitude of the first battery supply current level threshold and greater than a magnitude of the second battery supply current level threshold.

12. A circuit in accordance with claim 11 wherein the sense signal varies cyclically between the second boost current level threshold and the first boost current level threshold, when the first electrical signal is insufficient to maintain the sense signal above the second battery supply current level threshold.

13. A system in accordance with claim 11 further comprising a current sensing device coupled to the fuel injector solenoid, and a current sense amplifier responsive to current flowing through the current sensing device to provide the sense signal to each of the first and second comparators.

14. A method of energizing a load comprising:

applying a first electrical signal to the load to vary a load signal between a first maximum threshold and a first minimum threshold; and applying a second electrical signal to the load to vary the load signal between a second maximum threshold and a second minimum threshold, the second electrical signal having a magnitude substantially higher than the first electrical signal, wherein the second minimum threshold has a magnitude less than the magnitude of the first minimum threshold.

15. A method in accordance with claim 14 wherein the second maximum threshold has a magnitude less than a magnitude of the first maximum threshold and greater than a magnitude of the first minimum threshold.

16. A method in accordance with claim 14 wherein the load signal varies cyclically between the second minimum threshold and the second maximum threshold, when the first electrical signal is insufficient to maintain the load signal above the first minimum threshold.

17. A method in accordance with claim 15 wherein the first electrical signal and second electrical signal are applied during one of a pull-in time and a hold time.

18. A method in accordance with claim 16 wherein the first electrical signal and second electrical signal are applied during one of a pull-in time and a hold time.

19. A method of actuating a solenoid comprising:

providing a command signal for a predetermined period of time, the command signal having a pull-in time and a hold time;

applying a battery signal to the solenoid at a beginning of the pull-in time to increase current flow through the solenoid to a predetermined level; and applying a boost signal, when current flow through the solenoid reaches the predetermined level to cause the solenoid current to be cycled between a maximum boost current threshold and a minimum boost current threshold during one of the pull-in time and the hold time.

* * * * *